US007024851B2

(12) United States Patent
Akagi et al.

(10) Patent No.: US 7,024,851 B2
(45) Date of Patent: Apr. 11, 2006

(54) DIRECT FUEL INJECTION/SPARK IGNITION ENGINE CONTROL DEVICE

(75) Inventors: Mitsuhiro Akagi, Yokohama (JP); Tsutomu Kikuchi, Setagaya-ku (JP); Yuichi Iriya, Yokohama (JP); Hitoshi Ishii, Yokosuka (JP); Masahiro Fukuzumi, Machida (JP); Katsuaki Uchiyama, Yokohama (JP); Masahiko Yuya, Yokohama (JP); Takao Maitani, Isehara (JP); Masayuki Tomita, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 48 days.

(21) Appl. No.: 10/960,693

(22) Filed: Oct. 8, 2004

(65) Prior Publication Data

US 2005/0086930 A1 Apr. 28, 2005

(30) Foreign Application Priority Data

Oct. 28, 2003 (JP) ..... 2003-367853

(51) Int. Cl.
*F01N 3/00* (2006.01)

(52) U.S. Cl. ..... 60/285; 60/274; 60/286; 123/295; 123/300; 123/430

(58) Field of Classification Search ..... 60/274, 60/284, 285, 286; 123/295, 299, 300, 305, 123/430

See application file for complete search history.

(56) References Cited

U.S. PATENT DOCUMENTS

| | | | | |
|---|---|---|---|---|
| 5,975,046 | A * | 11/1999 | Kaneko et al. | 123/300 |
| 6,041,591 | A * | 3/2000 | Kaneko et al. | 60/274 |
| 6,234,139 | B1 * | 5/2001 | Taga et al. | 123/295 |
| 6,244,243 | B1 * | 6/2001 | Mamiya et al. | 123/295 |
| 6,330,796 | B1 | 12/2001 | Nishimura et al. | |
| 6,438,945 | B1 * | 8/2002 | Takagi et al. | 60/283 |
| 6,668,792 | B1 * | 12/2003 | Yamauchi et al. | 123/295 |

FOREIGN PATENT DOCUMENTS

| | | | |
|---|---|---|---|
| EP | 0943-793 | A | 9/1999 |
| JP | 60-36719 | A | 2/1985 |
| JP | 2000-145510 | A | 5/2000 |

* cited by examiner

*Primary Examiner*—Binh Q. Tran
(74) *Attorney, Agent, or Firm*—Shinjyu Global IP Counselors

(57) ABSTRACT

An engine control device is configured to perform optimum combustion control according to environmental conditions when warming up of a catalyst for emission purification is required. The engine control device performs stratified combustion by the compression stroke injection at the time of startup, when warming up of the catalyst is required. However, under conditions of low air density, stratified combustion by compression stroke injection is prevented, and either homogenous combustion by intake stroke injection is performed, or double injection combustion by intake stroke injection and compression stroke injection is performed. Thus, the engine control device maintains starting properties and prevents adverse effects on engine operability.

20 Claims, 5 Drawing Sheets

DIRECT FUEL INJECTION/SPARK IGNITION ENGINE CONTROL DEVICE

BACKGROUND OF THE INVENTION

1. Field of the Invention

The present invention generally relates to a control device for a direct fuel injection spark ignition engine. More specifically, the present invention relates to a control device that is suitable during cold starting and the like, or when it is necessary to warm up a catalyst for exhaust purification provided to the exhaust channel.

2. Background Information

One example of a direct fuel injection spark ignition engine is disclosed in Japanese Laid-Open Patent Application No. 2000-145510 in which a three-way catalyst is not activated during a cold start and HC is discharged without being reduced in the case of homogenous combustion by intake stroke injection. Thus, in this direct fuel injection spark ignition engine, when the temperature of the engine is detected and the detected temperature is below a prescribed temperature, the air/fuel ratio is adjusted to be leaner than the theoretical air/fuel ratio in the compression stroke, and the fuel is injected.

By performing stratified combustion by compression stroke injection during a cold start, fuel can be prevented from adhering to the cylinder walls, and the HC discharge quantity can be reduced. In addition, the exhaust temperature is increased, so warming up of the catalyst can be accelerated.

In view of the above, it will be apparent to those skilled in the art from this disclosure that there exists a need for an improved control device. This invention addresses this need in the art as well as other needs, which will become apparent to those skilled in the art from this disclosure.

SUMMARY OF THE INVENTION

However, it has been discovered that the density of the intake air is low in high-altitude and other low-pressure environments and in environments where the outside air temperature is high. Thus, in these situations, the actual quantity of air that can be taken in is reduced such that stable combustion is difficult. In other words, in these situations, difficulties in starting occur due to the inability to generate the necessary engine torque when operation is performed by stratified combustion. Even when the engine can be started, stable stratified combustion is also difficult to sustain during the engine warm-up period, and when the auxiliary load is increased after starting, for example, drawbacks in operability occur due to inadequate engine torque.

In view of the foregoing drawbacks, one object of the present invention is to perform optimal combustion control according to environmental conditions when warming up of the catalyst is required.

In view of the forgoing, a direct fuel injection/spark ignition engine control device apparatus is provided that basically comprises an environment condition determination section, a catalyst condition determination section and a combustion control section. The environment condition determination section is configured to determine a low intake air density condition that is adverse to stratified combustion by compression stroke injection. The catalyst condition determination section is configured to determine a state of a catalyst for exhaust purification disposed in an exhaust passage of an engine. The combustion control section is configured to control combustion modes such that a stratified combustion mode is performed with a compression stroke injection from a time of startup when warming up of the catalyst is determined, and such that the stratified combustion with the compression stroke injection is prevented and a combustion mode with an intake stroke injection is performed when warming up of the catalyst is determined under conditions of low air density.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

FIRST EMBODIMENT

Figure 1:
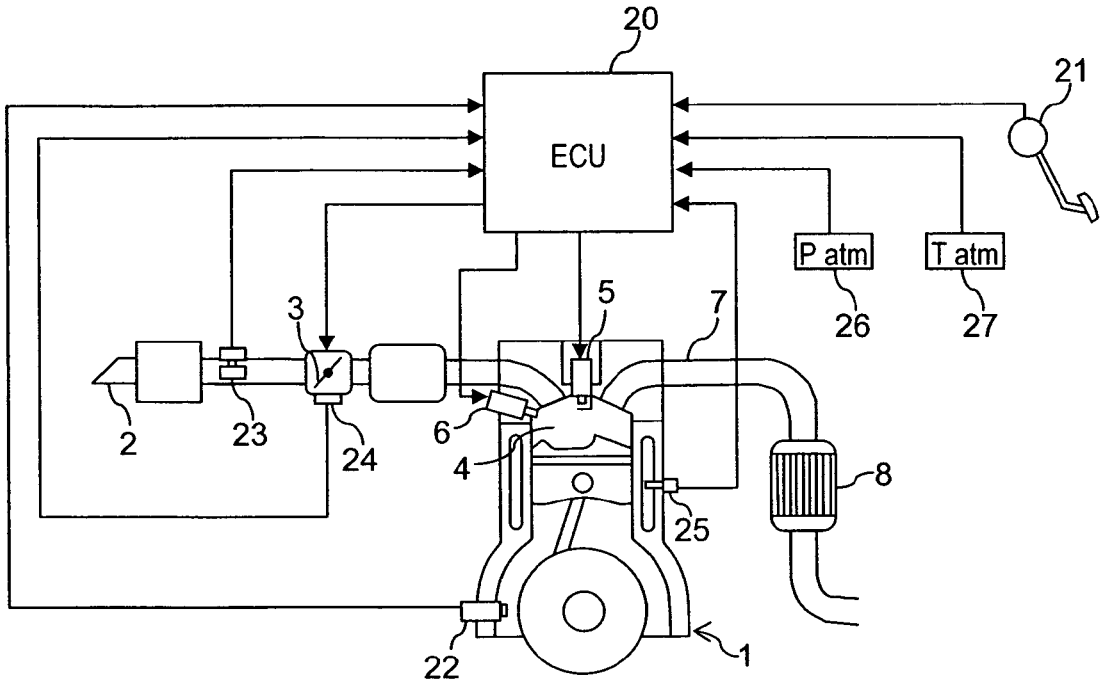
FIG. 1 is a diagrammatic view of an engine system illustrating a direct fuel injection/spark ignition engine control device for an internal combustion engine in accordance with a first embodiment of the present invention.

Referring initially to FIG. 1, a direct fuel injection/spark ignition engine 1 is diagrammatically illustrated that is equipped with a direct fuel injection/spark ignition engine control device in accordance with a first embodiment of the present invention. The engine 1 has an intake passage 2 with an electronically controlled throttle valve 3 mounted therein. The electronically controlled throttle valve 3 is configured and arranged for controlling the intake air quantity to the intake passage 2 of the engine 1. The intake passage 2 is fluidly connected to a plurality of combustion chambers 4 (only one shown) of the engine 1. Each combustion chamber 4 includes a spark plug 5 and a fuel injection valve 6. The spark plug 5 and the fuel injection valve 6 are mounted to the combustion chamber 4 in a conventional manner. The engine 1 also has an exhaust passage 7 fluidly connected to each combustion chamber 4. The exhaust passage 7 includes a catalytic converter 8 with a catalyst for exhaust purification in a conventional manner.

The engine is controlled by an engine control unit or ECU 20 to perform the controlled combustion of the fuel air mixture as discussed below. The engine control unit 20 is a microcomputer comprising of a central processing unit (CPU) and other peripheral devices. The engine control unit 20 can also include other conventional components such as an input interface circuit, an output interface circuit, and storage devices such as a ROM (Read Only Memory) device and a RAM (Random Access Memory) device. The engine control unit 20 preferably includes an engine control program that controls various components as discussed below. The engine control unit 20 receives input signals from various sensors (described below) that serve to detect the operating state of the engine 1 and executes the engine controls based on these signals. It will be apparent to those skilled in the art from this disclosure that the precise structure and algorithms for the engine control unit 20 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

The opening of the electronically controlled throttle valve 3 is controlled by a stepping motor or other device operated by the signal from the engine control unit 20.

The fuel injection valve 6 is configured so as to be opened by a solenoid energized by an injection pulse signal outputted from the engine control unit 20 in synchronization with the engine speed during an intake stroke or a compression stroke, and fuel that is pressurized at a prescribed pressure is injected. Thus, the fuel injected is distributed throughout the combustion chamber 4 such that a homogenous air/fuel mixture is formed in the case of an intake stroke injection, a stratified air/fuel mixture is formed around the spark plug 5 in the case of a compression stroke injection. The air/fuel mixture is ignited by the spark plug 5 based on an ignition signal from the engine control unit 20, and is burned (homogenous combustion mode, stratified combustion mode or double-injection combustion mode).

In the present invention, as explained below, direct fuel injection timing and ignition timing are adjusted by the engine control unit 20 to change a combustion mode based on a determination of a low intake air density condition that is adverse to stratified combustion by compression stroke injection. More specifically, the engine control unit 20 controls the direct fuel injection timing and the ignition timing such that a stratified combustion is performed by compression stroke injection from the time of startup when warming up of the catalyst is determined, and such that the stratified combustion by compression stroke injection is prevented and combustion by intake stroke injection is performed when warming up of the catalyst is determined under conditions of low air density.

Also, the rate of utilization of air is low in the case of stratified combustion by compression stroke injection, so torque cannot be produced if not enough air is taken in, but the rate of utilization of air increases in the case of homogenous combustion by intake stroke injection or in the case of double (split) injection combustion with an intake stroke injection and an compression stroke injection (weakly stratified combustion) in a single combustion cycle, so torque can be produced using these types of combustion even when air is sparse. Thus, starting properties can be maintained and decreased operability can be prevented by preventing stratified combustion by compression stroke injection and causing at least a portion of the fuel injectors to perform combustion by intake stroke injection.

The engine control unit 20 receives input signals from the following sensors: an accelerator pedal sensor 21, a clutch angle sensor 22, a heated airflow meter 23, a throttle sensor 24, an engine coolant temperature sensor 25, an atmospheric pressure sensor 26 and an outside air temperature sensor 27. The engine control unit 20 executes the engine controls including, but not limited to, the intake air quantity Qa, the ignition timing, the fuel injection quantity and fuel injection timing based on these signals.

The accelerator opening APO is detected by the accelerator pedal sensor 21, which outputs a signal to the engine control unit 20 that is indicative of the depression amount of the accelerator pedal. The engine speed Ne is detected by the clutch angle sensor 22, which outputs a signal to the engine control unit 20 that is indicative of the engine speed Ne. The intake air quantity Qa is detected by the heated airflow meter 23, which outputs a signal to the engine control unit 20 that is indicative of the intake air quantity Qa. The throttle opening TVO is detected by the throttle sensor 24, which outputs a signal to the engine control unit 20 that is indicative of the throttle opening TVO. The engine coolant temperature Tw is detected by the engine coolant temperature sensor 25, which outputs a signal to the engine control unit 20 that is indicative of the engine coolant temperature Tw. The atmospheric pressure Patm is detected by the atmospheric pressure sensor 26, which outputs a signal to the engine control unit 20 that is indicative of the atmospheric pressure Patm. The outside air temperature (intake air temperature) Tatm is detected by the outside air temperature sensor 27 which outputs a signal to the engine control unit 20 that is indicative of the intake air temperature Tatm.

The engine control unit 20 is configured to select a selected combustion mode (homogenous combustion, stratified combustion, or double-injection combustion) based on the engine operating conditions detected by these input signals, and control the opening of the electronically controlled throttle valve 3, the fuel injection timing and fuel injection quantity of the fuel injection valve 6, and the ignition timing of the spark plug 5 accordingly. Also, under normal operating conditions (after warming-up is completed), extremely lean stratified combustion is performed with an A/F ratio of about 30 to 40 (stratified lean combustion). Homogenous lean combustion (A/F=20 to 30) and homogenous stoichiometric combustion are included as a homogenous combustion mode.

The present invention entails performing optimum combustion control according to environmental conditions when warming up is required for the catalyst in the catalytic converter 8, which includes cold starting. This type of control is performed by the engine control unit 20 as control from startup to during warm-up in accordance with the flowchart in FIG. 2.

Figure 2:
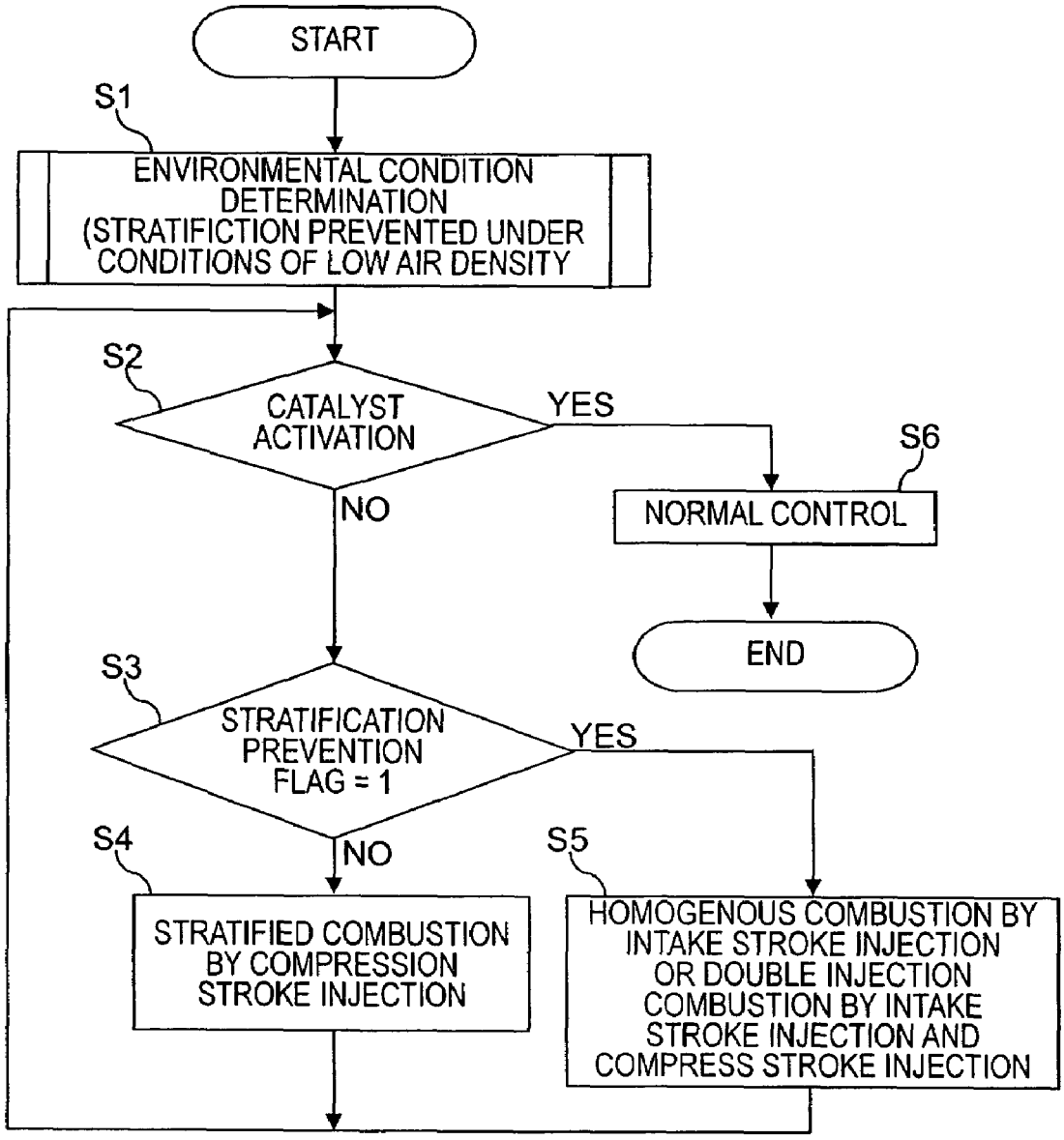
FIG. 2 is a flowchart showing the control operations executed from startup to during warm-up by the control unit of the direct fuel injection/spark ignition engine control device in accordance with the first embodiment of the present invention.

The flowchart of control from startup to during warm-up in FIG. 2 will be described.

In step S1, the environmental conditions are determined at the time of startup, and a flag is set so as to prevent stratified combustion (stratified startup) under conditions of low air density. Thus, this step S1 constitutes an environment condition determination section that is configured to determine a low intake air density condition having an adverse affect on stratified combustion by compression stroke injection. Specifically, this step S1 is performed according to the environmental condition determination subroutine shown in FIG. 3.

Figure 3:
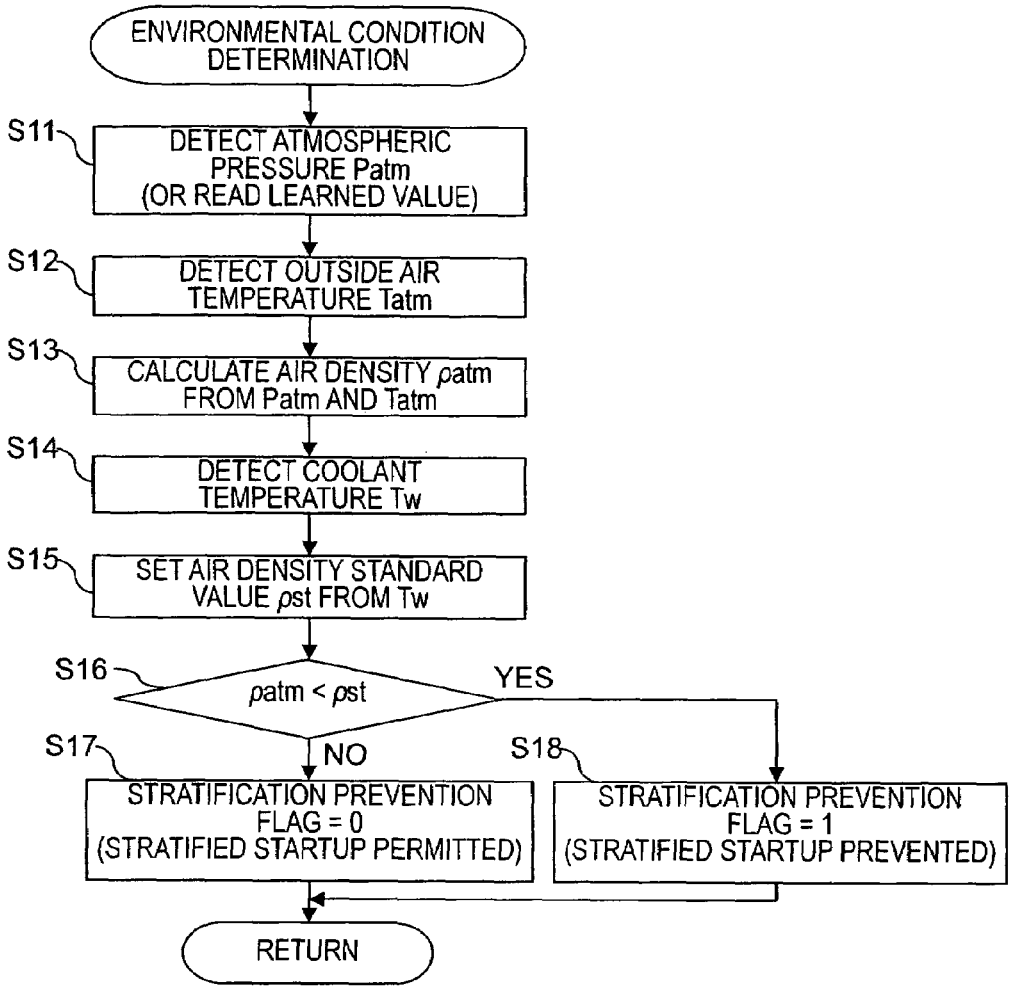
FIG. 3 is a first environmental condition determination flowchart showing the control operations of the environmental condition determination subroutine executed by the control unit of the direct fuel injection/spark ignition engine control device in accordance with the first embodiment of the present invention.

Referring to the flowchart of FIG. 3, the atmospheric pressure Patm is detected by the atmospheric pressure sensor 26 in step S1. When there is no atmospheric pressure sensor 26 provided, the atmospheric pressure Patm is determined (learned) from the throttle opening TVO and the intake air quantity Qa and stored before the engine 1 is stopped, and the learned value is read at the time of startup. This learning can be performed, for example, based on the ratio of the actual intake air quantity Qa with respect to a fundamental target intake air quantity Qm established in advance at idle operating conditions when the throttle is fully closed.

The outside air temperature Tatm is then detected by the outside air temperature sensor 27 in step S12. The air density Patm is then calculated in step S13 from the atmospheric pressure Patm and outside air temperature Tatm.

Figure 4:
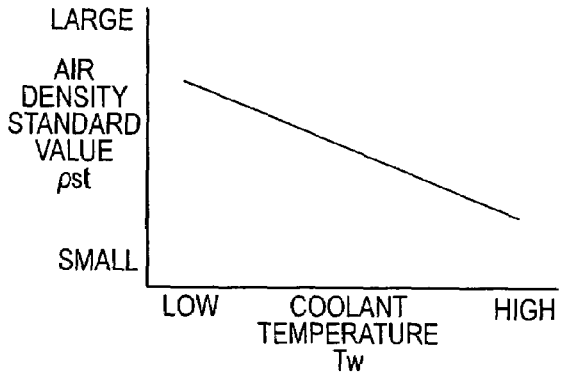
FIG. 4 is a first diagrammatic graph illustrating the relationship between air density and coolant temperature to determine the air density standard value in accordance with the first embodiment of the present invention.

In step S14, the coolant temperature Tw is detected by the water temperature sensor 25. A graph or map such as the one in FIG. 4 is then referenced in step S15 to set the air density standard value (air density required for stratified combustion) pst from the coolant temperature Tw. This graph or map is configured so that the air density standard value pst is increased as the coolant temperature Tw decreases. This is because the lower the engine temperature, the higher the frictional loss and greater the necessary quantity of air, so the air density required for stratified combustion increases. The characteristic of the air density standard value pst is shown as a linear function of the coolant temperature Tw in FIG. 4, however, this is merely a general characteristic of the relationship between the air density standard value pst and the coolant temperature Tw for the sake of simplicity.

In step S16, the air density patm calculated in step S13 is compared with the air density standard value pst that is set in step S15 to determine whether patm<pst (condition in which the air density is at or below the standard value) exists. As a result, the processing proceeds to step S17, when this determination is NO (i.e., patm>pst), where stratified startup is permitted with the stratification prevention flag is set to 0. In contrast, when the result of the determination is YES (i.e., patm<pst), the processing proceeds to step S18, where stratified startup is prevented with the stratification prevention flag is set to 1. The subroutine in FIG. 3 is thus concluded, and the process returns to step S2 of the main routine in FIG. 2.

In step S2, the engine control unit 20 determines whether the catalytic converter 8 is activated. Thus, this step S2 constitutes a catalyst condition determination section that is configured to determine a state of a catalyst for exhaust purification disposed in the exhaust passage 7 of the engine 1. Specifically, the catalyst temperature is detected when there is a catalyst temperature sensor present. When there is no catalyst temperature sensor, the catalyst temperature is estimated from the coolant temperature Tw. Alternatively, the catalyst temperature is estimated based on the coolant temperature at startup and the integrated value of the intake air quantity after startup. It is then determined whether the detected or estimated catalyst temperature is at or above a prescribed activity temperature.

When the catalyst is activated, the processing proceeds to step S6 and changes over to normal control, and the control during warm-up is concluded. The aforementioned stratified lean combustion, the homogenous lean combustion, the homogenous stoichiometric combustion, and the like are performed according to operating conditions in normal control.

The processing proceeds to step S3 when the catalyst is not activated.

In step S3, the value of the stratification prevention flag that is set in step S1 (subroutine in FIG. 3) is determined, and when the stratification prevention flag is 0, then processing proceeds to step S4 and stratified combustion by compression stroke injection is performed from the time of startup.

In the stratified combustion mode, the air/fuel ratio is set to be about stoichiometric, preferably slightly leaner than stoichiometric (A/F=15 to 16), fuel is injected to form a rich air-fuel mixture in stratified fashion around the spark plug in the later injection of the compression stroke, and stratified combustion is performed. The ignition timing (fundamental ignition timing that is set based on the coolant temperature Tw) is also corrected towards lag at this time (stratified retarded combustion).

When the stratification prevention flag is 1 under conditions of low air density, the processing proceeds to step S6 where either a homogenous combustion mode with an intake stroke injection is performed from the time of startup, or a double injection combustion mode with an intake stroke injection and a compression stroke injection is performed from the time of startup.

In homogenous combustion, the air/fuel ratio is set to be stoichiometric, fuel is injected in the intake stroke to form an air-fuel mixture that is homogenous throughout the combustion chamber, and homogenous combustion is performed. The ignition timing is also corrected towards lag at this time (homogenous retarded combustion).

In the double-injection combustion, the air/fuel ratio is set to be substantially stoichiometric or slightly lean (A/F=15 to 16) with the fuel injection being divided into two separate injection with one occurring in the intake stroke injection and one occurring in the compression stroke injection such that a comparatively rich air-fuel mixture is formed around the spark plug, and a comparatively lean air-fuel mixture is formed in the periphery thereof. In other words, the double-injection combustion performs a weakly stratified combustion. The ignition timing is also corrected towards lag at this time (double injection retarded combustion).

The process returns to step S2 after step S4 or step S6, and control is continued after startup as well as during warm-up, i.e., until the catalyst is activated. The catalytic converter 8 is activated by the control during warm-up, whereupon the processing proceeds from step S2 to step S6 and changes over to normal control. Thus, this steps S3 to S6 constitute a combustion control section that is configured to control direct fuel injection timing and ignition timing such that stratified combustion is performed by compression stroke injection from the time of startup when warming up of the catalyst is determined, and such that the stratified combustion by compression stroke injection is prevented and combustion by intake stroke injection is performed when warming up of the catalyst is determined under conditions of low air density.

Stratified combustion in a cold state enhances combustion stability by concentrating a strong air-fuel mixture around the spark plug. There is also less fuel adhering to the walls of the combustion chamber, so the level of HC discharged from the engine can be lowered. Despite the drawback of low robustness, combustion stability is enhanced, so the ignition timing can be retarded by a commensurate amount, and increased exhaust temperature for accelerating warm-up of the catalyst can be obtained.

However, under conditions of low air density, the actual quantity of air that can be taken in is reduced, so an adequate quantity of air cannot be taken in when operation is attempted by stratified combustion, resulting in poor starting properties due to the inability to generate the necessary engine torque and obtain stable combustion. Even when the engine can be started, stable stratified combustion is also difficult to sustain during the engine warm-up period, and when the auxiliary load is increased after starting, for example, drawbacks in operability occur due to inadequate engine torque.

Therefore, starting properties are maintained and adverse effects on operability are avoided by preventing stratified combustion by compression stroke injection from occurring, and causing homogenous combustion to be performed by intake stroke injection under conditions of low air density. This is because the rate of utilization of air increases in the case of homogenous combustion by intake stroke injection, so torque can be produced using this type of combustion even when air is sparse. The HC discharge quantity is greater in the case of homogenous combustion than in the case of stratified combustion, but increased exhaust temperature for accelerating warm-up of the catalyst can be obtained by retarding the ignition timing as much as possible.

SECOND EMBODIMENT

Figure 5:
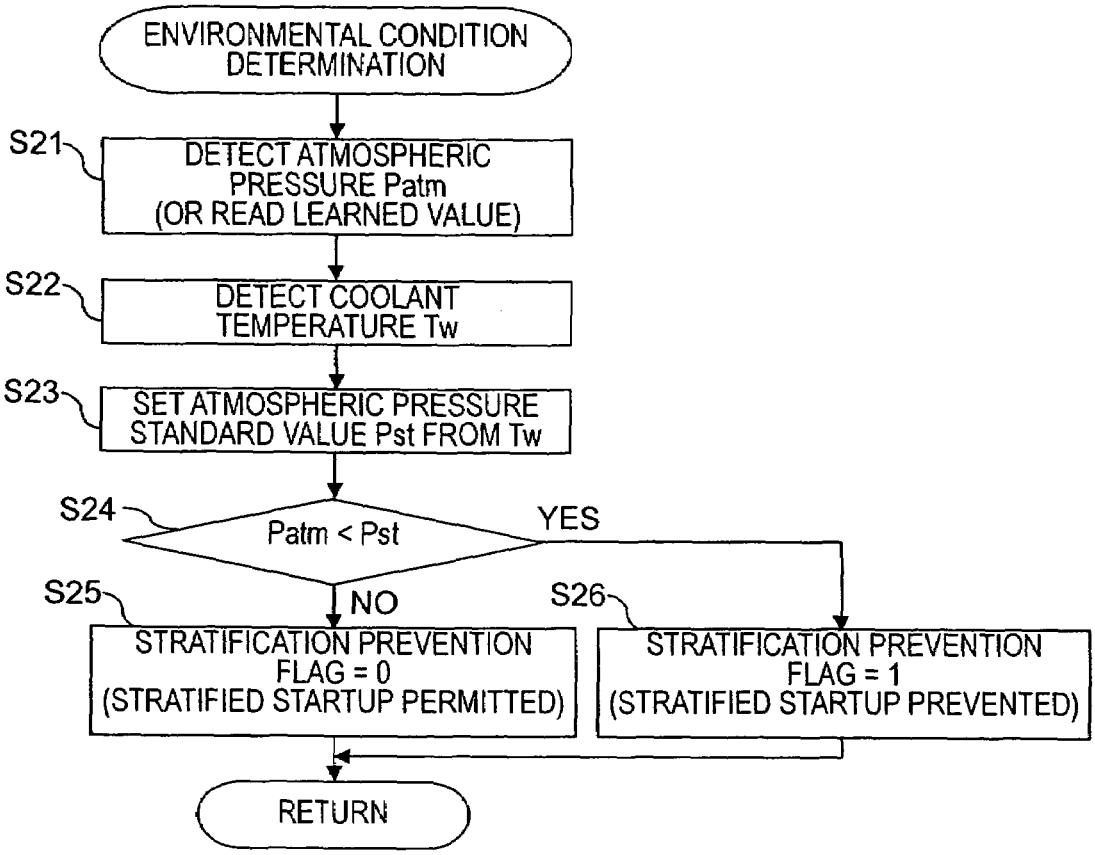
FIG. 5 is a second environmental condition determination flowchart showing the control operations of the environmental condition determination subroutine executed by the control unit of the direct fuel injection/spark ignition engine control device in accordance with a second embodiment of the present invention.
Figure 6:
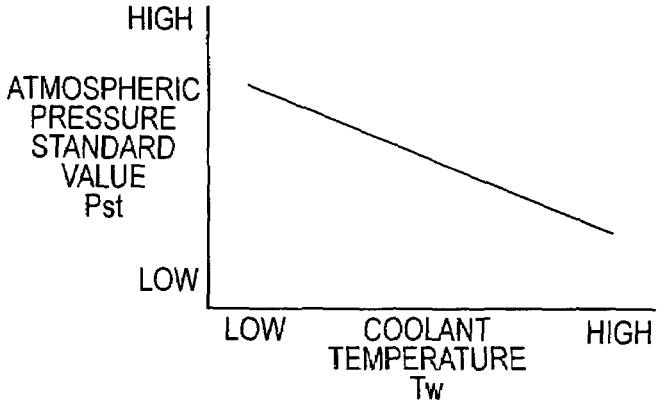
FIG. 6 is a second diagrammatic graph illustrating the relationship between air density and coolant temperature to determine the air density standard value in accordance with the second embodiment of the present invention.
Figure 7:
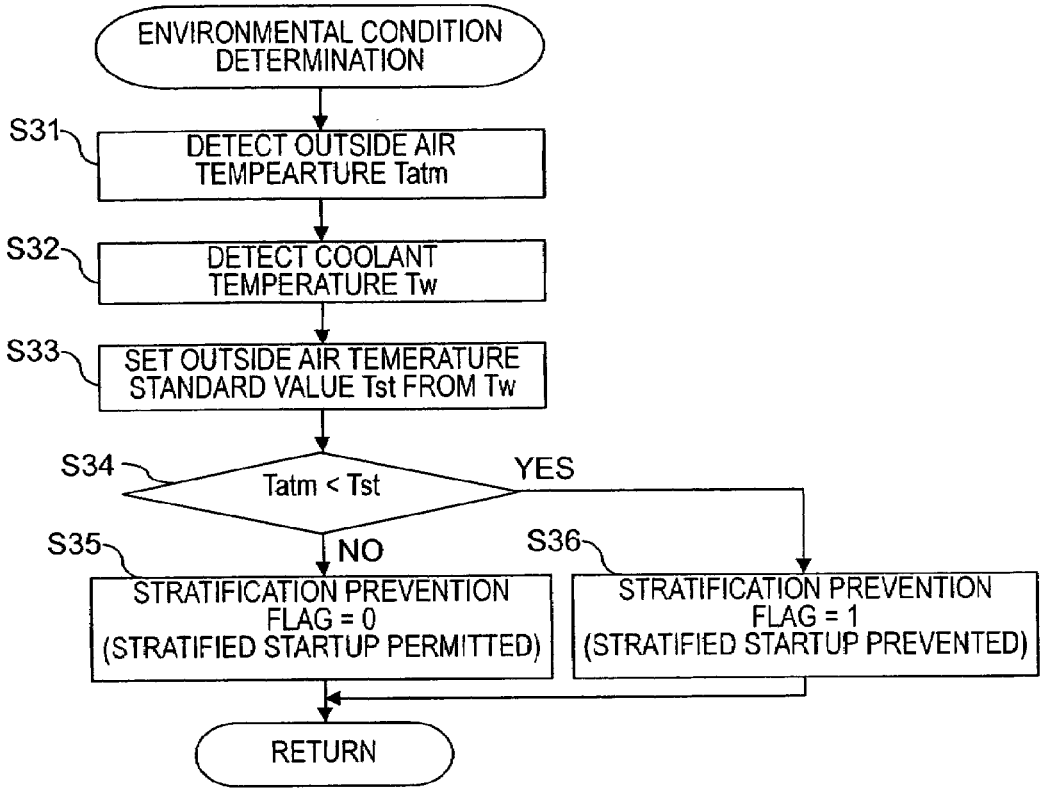
FIG. 7 is a third environmental condition determination flowchart showing the control operations of the environmental condition determination subroutine executed by the control unit of the direct fuel injection/spark ignition engine control device in accordance with a third embodiment of the present invention.

Referring now to FIGS. 5 and 6, a direct fuel injection/spark ignition engine control device in accordance with a second embodiment of the present invention will next be described. The direct fuel injection/spark ignition engine control device of the second embodiment of the present invention is used in a vehicle equipped with the direct fuel injection/spark ignition engine 1 as seen in FIG. 1. In other words, the second embodiment is the same as the first embodiment, except for different programming of the engine control unit 20 is used in step S1. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. In other words, unless otherwise specified, the rest of the configuration of the second embodiment is the same as the configuration of the first embodiment.

FIG. 5 shows the environmental condition determination subroutine of the second embodiment that is used in step S1.

The atmospheric pressure Patm is detected in step S21 by the atmospheric pressure sensor 26. If the atmospheric pressure sensor 26 is eliminated, a configuration is adopted whereby a learned value is read in as the atmospheric pressure Patm as described above.

The coolant temperature Tw is detected in step S22 by the water temperature sensor 25. In step S23, a graph or map such as the one in FIG. 6 is then referenced to set the atmospheric pressure standard value (atmospheric pressure required for stratified combustion) Pst from the coolant temperature Tw. This graph or map is configured so that the atmospheric pressure standard value Pst increases as the coolant temperature Tw decreases. This is because the lower the engine temperature, the higher the frictional loss and the greater the atmospheric pressure necessary for stratified combustion. The characteristic of the atmospheric pressure standard value Pst is shown as a linear function of the coolant temperature Tw in the FIG. 6, however, this is merely a general characteristic of the relationship between the atmospheric pressure standard value Pst and the coolant temperature Tw for the sake of simplicity.

In step S24, the air density Patm calculated in step S21 is compared with the atmospheric pressure standard value Pst set in step S23 to determine whether Patm<Pst (condition in which the atmospheric pressure is at or below the standard value) exists. As a result, the processing proceeds to step S25 when this determination is NO (i.e., Patm>Pst), and stratified startup is permitted with the stratification prevention flag equal to 0. In contrast, when the result of the determination is YES (i.e., Patm<Pst), the processing proceeds to step S26, and stratified startup is prevented with the stratification prevention flag equal to 1.

Control can thus be performed in a simpler manner by setting the condition of low air density to be a condition in which the atmospheric pressure is at or below a standard value.

THIRD EMBODIMENT

Referring now to FIGS. 5 and 6, a direct fuel injection/spark ignition engine control device in accordance with a third embodiment of the present invention will next be described. The direct fuel injection/spark ignition engine control device of the third embodiment of the present invention is used in a vehicle equipped with the direct fuel injection/spark ignition engine 1 as seen in FIG. 1. In other words, the third embodiment is the same as the first embodiment, except for different programming of the engine control unit 20 is used in step S1. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity. In other words, unless otherwise specified, the rest of the configuration of the third embodiment is the same as the configuration of the first embodiment.

FIG. 5 shows the environmental condition determination subroutine of the third embodiment that is used in step S1.

The outside air temperature Tatm is detected in step S31 by the outside air temperature sensor 27.

Figure 8:
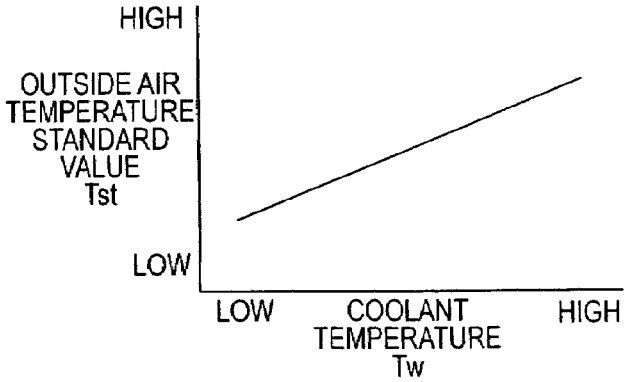
FIG. 8 is a third diagrammatic graph illustrating the relationship between air density and coolant temperature to determine the air density standard value in accordance with the third embodiment of the present invention.

The coolant temperature Tw is detected in step S32 by the water temperature sensor 25. A graph or map such as the one in FIG. 8 is then referenced in step S33 to set the outside air temperature standard value (outside air temperature required for stratified combustion) Tst from the coolant temperature Tw. This graph or map is configured so that the outside air temperature standard value Tst is lowered as the coolant temperature Tw decreases. This is because the lower the engine temperature, the higher the frictional loss and the greater the quantity of air necessary for stratified combustion, so the outside air temperature required for stratified combustion decreases. The characteristic of the outside air temperature standard value Tst is shown as a linear function of the coolant temperature Tw in the FIG. 6, however, this is merely a general characteristic of the relationship between the outside air temperature standard value Tst and the coolant temperature Tw for the sake of simplicity.

In step S34, the outside air temperature Tatm detected in step S31 is compared with the outside air temperature standard value Tst set in step S33 to determine whether Tatm>Tst (condition in which the outside air temperature is at or above the standard value) exists. As a result, the processing proceeds to step S35 when this determination is NO (i.e., Tatm<Tst), and stratified startup is permitted with the stratification prevention flag equal to 0. In contrast, when the result of the determination is YES (i.e., Tatm>Tst), the processing proceeds to step S36, and stratified startup is prevented with the stratification prevention flag equal to 1.

Control can thus be performed in a simpler manner by setting the condition of low air density to be a condition in which the outside air temperature is at or above a standard value.

The examples described above were configured such that stratified combustion by compression stroke injection is prevented and combustion by intake stroke injection is performed when warming up of the catalyst is required under conditions of low air density, but a configuration may also be adopted whereby stratified combustion by compression stroke injection is prevented and double injection combustion with an intake stroke injection and a compression stroke injection (weakly stratified combustion) is performed.

The air/fuel ratio is set to be stoichiometric or slightly lean (A/F=15 to 16) in double injection combustion. In a double injection combustion, the injection is split injection between an intake stroke injection and an compression stroke injection with the intake stroke injection and the compression stroke injection being performed to form a comparatively rich air-fuel mixture around the spark plug and a comparatively lean air-fuel mixture is formed in the periphery thereof, such that a weakly stratified combustion is performed. The ignition timing is also corrected towards lag at this time (double injection retarded combustion).

Double injection combustion is inferior to homogenous combustion as far as the utilization rate of air is concerned, but is superior in this regard to stratified combustion, so more torque can be produced thereby than by stratified combustion under conditions of low air density.

Because double injection combustion in a cold state forms a comparatively rich fuel-air mixture around the spark plug and forms a comparatively lean air-fuel mixture at the periphery thereof, although HC reducing effects are inferior to stratified combustion from the perspective of adherence of fuel to the walls of the combustion chamber, these effects are superior to homogenous combustion. Fuel is also passed throughout the combustion chamber, so combustion can be stabilized and the exhaust temperature can be increased by retardation of the ignition timing.

The term "configured" as used herein to describe a component, section or part of a device includes hardware and/or software that is constructed and/or programmed to carry out the desired function. Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2003-367853. The entire disclosure of Japanese Patent Application No. 2003-367853 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A direct fuel injection/spark ignition engine control device comprising:

an environment condition determination section configured to determine a low intake air density condition that is adverse to stratified combustion by compression stroke injection;

a catalyst condition determination section configured to determine a state of a catalyst for exhaust purification disposed in an exhaust passage of an engine; and a combustion control section configured to control combustion modes such that a stratified combustion mode is performed with a compression stroke injection from a time of startup when warming up of the catalyst is determined, and such that the stratified combustion with the compression stroke injection is prevented and a combustion mode with an intake stroke injection is performed when warming up of the catalyst is determined under conditions of low air density.

2. The direct fuel injection/spark ignition engine control device according to claim 1, wherein the combustion control section is further configured to perform the combustion mode with the intake stroke injection as a homogenous combustion.

3. The direct fuel injection/spark ignition engine control device according to claim 2, wherein the environment condition determination section is further configured to determine the low intake air density condition by determining an intake air density being at or below a standard value with the intake air density being calculated from atmospheric pressure and outside air temperature.

4. The direct fuel injection/spark ignition engine control device according to claim 2, wherein the environment condition determination section is further configured to determine the low intake air density condition based on a condition in which atmospheric pressure is at or below a standard value.

5. The direct fuel injection/spark ignition engine control device according to claim 2, wherein the environment condition determination section is further configured to determine the low intake air density condition based on a condition in which outside air temperature is at or above a standard value.

6. The direct fuel injection/spark ignition engine control device according to claim 1, wherein the combustion control section is further configured to perform the combustion mode with the intake stroke injection as a double injection combustion with one fuel injection being the intake stroke injection and another fuel injection during a compression stroke.

7. The direct fuel injection/spark ignition engine control device according to claim 6, wherein the environment condition determination section is further configured to determine the low intake air density condition by determining an intake air density being at or below a standard value with the intake air density being calculated from atmospheric pressure and outside air temperature.

8. The direct fuel injection/spark ignition engine control device according to claim 6, wherein the environment condition determination section is further configured to determine the low intake air density condition based on a condition in which atmospheric pressure is at or below a standard value.

9. The direct fuel injection/spark ignition engine control device according to claim 6, wherein the environment condition determination section is further configured to determine the low intake air density condition based on a condition in which outside air temperature is at or above a standard value.

10. The direct fuel injection/spark ignition engine control device according to claim 1, wherein the environment condition determination section is further configured to determine the low intake air density condition by determining an intake air density being at or below a standard value with the intake air density being calculated from atmospheric pressure and outside air temperature.

11. The direct fuel injection/spark ignition engine control device according to claim 10, wherein the environment condition determination section is further configured to determine the atmospheric pressure from an engine throttle opening and an intake air quantity occurring prior to stopping the engine.

12. The direct fuel injection/spark ignition engine control device according to claim 10, wherein the environment condition determination section is further configured to set the standard value according to engine temperature.

13. The direct fuel injection/spark ignition engine control device according to claim 1, wherein the environment condition determination section is further configured to determine the low intake air density condition based on a condition in which atmospheric pressure is at or below a standard value.

14. The direct fuel injection/spark ignition engine control device according to claim 13, wherein the environment condition determination section is further configured to set the standard value according to engine temperature.

15. The direct fuel injection/spark ignition engine control device according to claim 13, wherein the environment condition determination section is further configured to determine the atmospheric pressure from an engine throttle opening and an intake air quantity occurring prior to stopping the engine.

16. The direct fuel injection/spark ignition engine control device according to claim 15, wherein the environment condition determination section is further configured to set the standard value according to engine temperature.

17. The direct fuel injection/spark ignition engine control device according to claim 1, wherein the environment condition determination section is further configured to determine the low intake air density condition based on a condition in which outside air temperature is at or above a standard value.

18. The direct fuel injection/spark ignition engine control device according to claim 17, wherein the environment condition determination section is further configured to set the standard value according to engine temperature.

19. A direct fuel injection/spark ignition engine control device comprising:

environment condition determination means for determining a low intake air density condition that is adverse to stratified combustion by compression stroke injection;

catalyst condition determination means for determining a state of a catalyst for exhaust purification disposed in an exhaust passage of an engine; and combustion control means for controlling a combustion mode such that a stratified combustion mode is performed with a compression stroke injection from the time of startup when warming up of the catalyst is determined, and such that the stratified combustion with the compression stroke injection is prevented and a combustion mode with an intake stroke injection is performed when warming up of the catalyst is determined under conditions of low air density.

20. A method of controlling combustion in a direct fuel injection/spark ignition engine comprising:

determining a low intake air density condition that is adverse to stratified combustion by compression stroke injection;

determining a state of a catalyst for exhaust purification disposed in an exhaust passage of an engine; and controlling a combustion mode such that a stratified combustion mode is performed with a compression stroke injection from a time of startup when warming up of the catalyst is determined, and such that the stratified combustion mode with the compression stroke injection is prevented and a combustion mode with an intake stroke injection is performed when warming up of the catalyst is determined under conditions of low air density.

* * * * *